United States Patent [19]

Schmidt

[11] Patent Number: 4,715,134

[45] Date of Patent: Dec. 29, 1987

[54] ROTARY SNOW PLOUGH

[75] Inventor: Alfred Schmidt, Bernau, Fed. Rep. of Germany

[73] Assignee: Ing. Alfred Schmidt GmbH, St. Blasien, Fed. Rep. of Germany

[21] Appl. No.: 694,657

[22] Filed: Jan. 24, 1985

[30] Foreign Application Priority Data

Feb. 10, 1984 [DE] Fed. Rep. of Germany ..... 3404847

[51] Int. Cl.[4] ..... E01H 5/09

[52] U.S. Cl. ..... 37/238; 37/248; 37/253

[58] Field of Search ..... 37/238, 253, 248, 209, 37/244

[56] References Cited

U.S. PATENT DOCUMENTS

| | | | |
|---|---|---|---|
| 1,328,973 | 1/1920 | Stowell | 37/209 X |
| 1,532,567 | 4/1925 | Aldinger | 37/248 |
| 2,733,524 | 2/1956 | Ingbritson | 37/248 |
| 3,308,563 | 3/1967 | Danek | 37/238 X |
| 3,720,299 | 3/1973 | Wegmann et al. | 37/238 X |
| 4,443,958 | 4/1984 | Huotari | 37/238 |

*Primary Examiner*—Edgar S. Burr
*Assistant Examiner*—Moshe I. Cohen
*Attorney, Agent, or Firm*—George E. Kersey

[57] ABSTRACT

In a rotary snow plough having a feed plough arranged on a side of its housing (2) in order to increase the intake cross section, the accumulation of snow on the ploughshare (8) of the feed plough (4) is avoided by providing, in the ploughshare (8), a belt conveyor element (11) supplying the rotary element(s) of the rotary plough.

7 Claims, 3 Drawing Figures

Fig.1
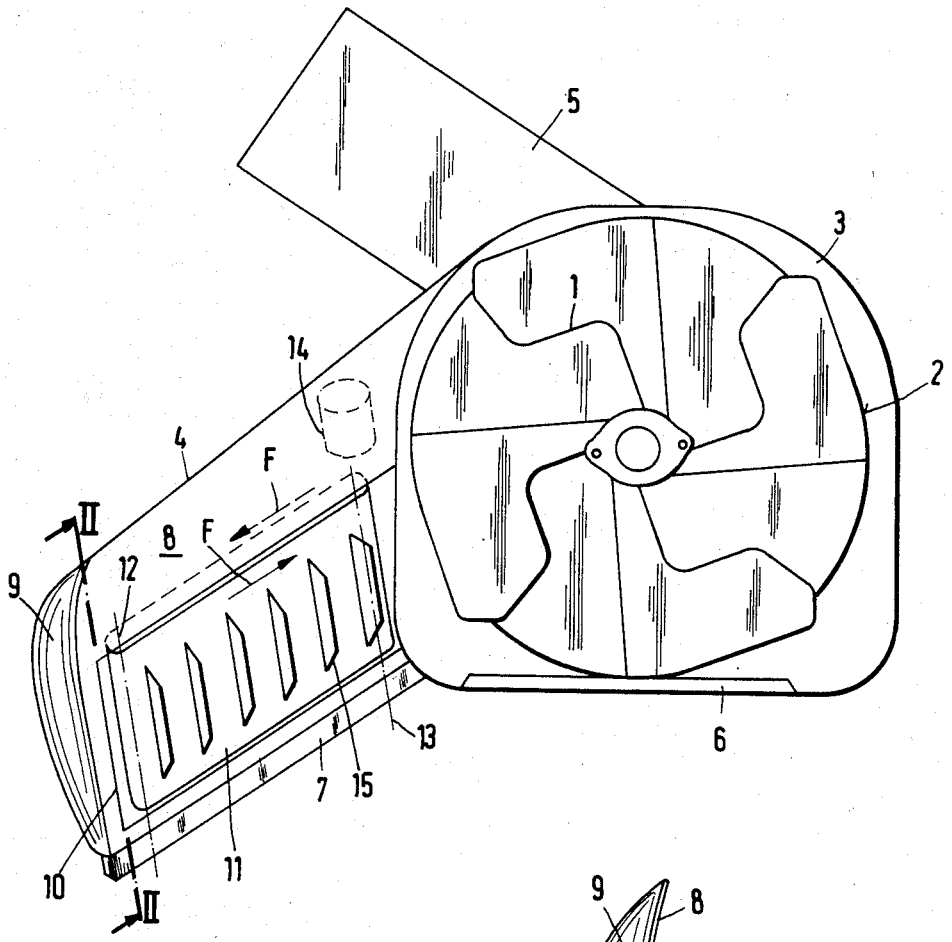
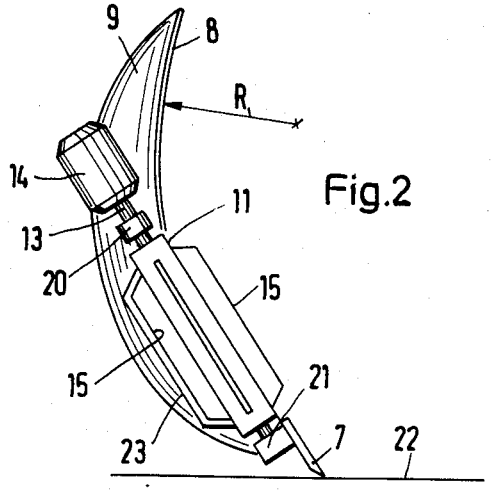
Fig.2
Fig.3
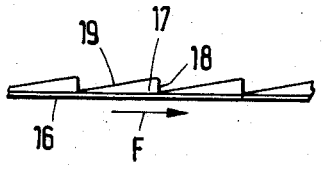

ROTARY SNOW PLOUGH

BACKGROUND OF THE INVENTION

1. Field of the Invention

The invention relates to a rotary snow plough having feed ploughs attached to one or to both sides of its housing in order to increase the intake cross section.

2. Brief Description of the Prior Art

Depending on the desired clearing width, it is known to extend rotary snow ploughs on one or both sides of the rotary element(s) of the plough. These extensions, which are in the form of so-called feed ploughs, form, as it were, a funnel running towards the rotary cross section.

It has been shown that where relatively large amounts of snow are involved, and particularly in the case of wet snow, blockage occurs in the region of the intake cross section in such rotary snow ploughs, even at the customary clearing speeds. As a result, it becomes impossible for any more snow to enter the rotary stage and, instead, the piled-up mass of snow is pushed along in front of the vehicle. The effects of this phenomenon are especially adverse in a typical area of application for such rotary snow ploughs, namely airfields, where high clearing and conveying speeds (up to about 30 km/h) are essential.

This disadvantage can be avoided by using rotary snow ploughs (German Patent Specification No. 27 21 411) which have endless clearing screws rotating about vertical axes on both sides of the throwing wheel or ejecting fan forming the rotary stage of the plough and in front of the wheel housing in the direction of clearing. These endless clearing screws keep the entrapped snow moving, and convey it from the ground upwards to a point in front of the throwing wheel or fan, so that any packing or accumulation of the snow is avoided.

An arrangement, even though it is less effective, for removing snow in the region of the intake cross section of a rotary snow plough consists of an endless conveyor screw which is arranged along one lateral wall of the plough housing with its longitudinal axis guided obliquely forwards and downwards (DE-OS No. 2 039 187). This prevents a mass of snow from accumulating against the projecting lateral wall of the housing.

Finally, in a rotary snow plough for railway vehicles having cutting rollers rotating about vertical axes arranged in front of the throwing wheel (US-PS No. 931,559), it is known to transport the snow that has been taken from the region of the track by the cutting rollers to the throwing wheel or ejecting fan, by means of a conveyor belt that is approximately parallel with the ground. It is intended thereby that even the snow present in the region of the track shall be taken up, thus enabling it to be drawn into the ejecting fan.

SUMMARY OF THE INVENTION

Compared with the state of the art mentioned initially, in which the ploughshares of the feed ploughs form smooth lateral walls against which the snow accumulates, the object of the invention is to avoid such an accumulation of snow using measures that can be embodied more simply and inexpensively than is the case with the known high-performance rotary snow ploughs having additional endless clearing screws.

This object is achieved according to the invention, in that at least the ploughshares of the or each feed plough includes a belt conveyor element arranged to supply the rotary element(s) of the rotary plough.

According to this proposed solution, the preferred location for the attachment of such a belt conveyor element is the lateral wall or, in the case of a symmetrical construction, each lateral wall, of the fender constructed in front of the drum-type housing of the actual rotary element(s) of the rotary snow plough. The walls of the ploughshare may be constructed entirely or, alternatively, in sections only, as a belt conveyor element.

The effect of such a belt conveyor element resides primarily in the fact that it prevents any snow from settling on the housing parts of the plough and, additionally, still conveys the snow to the actual rotary element(s) of the plough.

Suitable belt conveyor elements are known per se. In connection with the medium of snow, they are used, for example, as caterpillars drives for snow vehicles where they take the form of reinforced rubber belts with protruding ribs or similar raised parts which run transversely to the direction of rotation of the belts with which the belts grip the snow beneath them.

A preferred embodiment of the invention provides for the plane of the belt conveyor element to be parallel with the ploughshare plane and to be placed obliquely with respect to the ground so that the rear side of the ploughshare, in the direction of travel, forms an acute angle with the ground surface.

As an advantageous arrangement of the belt conveyor elements, provision is made for each of these to be oriented with its conveying direction towards or above the rotational axis of the rotary element(s). In this manner, the transported snow is distributed as uniformly as possible across the cross section of the rotary element(s).

The belt conveyor element may be installed either in an aperture in the housing parts holding it, or may be so arranged that the outermost return point of the belt conveyor element forms the outer edge of the ploughshare.

The drive for the belt conveyor element is preferably independent of the drive of the rotary element(s) of the rotary plough. An hydraulic drive is especially suitable, wherein a suitable oil motor may be arranged on the rear side of the part of a wall, for example of a ploughshare, holding the belt conveyor element.

The rotational speed of the belt conveyor element is preferably variable; advantageously, it corresponds approximately to at least the particular clearing speed, wherein an automatic adjustment of the rotational speed to the clearing speed is provided. When the snow is carried away by the belt conveyor elements as quickly as the clearing vehicle enters fresh masses of snow, snow is unable to accumulate.

When the belt conveyor element is in the form of a conveyor belt with projections, the latter may be of plate-like or overlapped construction. In order to ensure a low sliding resistance even when the belt conveyor element is stationary, the projections are advantageously so designed that they have a crosssectional shape that rises obliquely in the direction of transport. Alternatively, the projections may be fastened to the conveyor belt, so as to fold down, so that they lie closely against the surface of the conveyor belt. This variant permits a troublefree operation of the clearing vehicle even with the conveyor elements stationary, which could be advantageous, for example, when clearing powdery snow.

DESCRIPTION OF THE DRAWINGS

A rotary snow plough constructed according to the invention is described below, by way of example, with reference to the accompanying drawings, in which FIG. 1 shows a front view of the rotary snow plough, FIG. 2 shows a section on the line II—II of FIG. 1, and, FIG. 3 shows a portion of an alternative form of conveyor belt.

DETAILED DESCRIPTION OF THE PREFERRED EMBODIMENTS OF THE INVENTION

According to FIG. 1, the rotary snow plough consists of a throwing wheel 1, or ejecting fan, forming a rotary element of the plough, which is arranged inside an approximately drum-shaped housing 2. The housing 2, in its turn, has other parts built onto the front thereof, namely, an annular apron 3, an ejection chute 5, and a laterally-mounted feed plough 4. In FIG. 1, a feed plough is shown on one side only of the housing 2 but it will be appreciated that feed ploughs could be provided on both sides of the housing, if required. On its underside, the housing apron 3 carries a wearing rail 6 arranged to slide over the surface of the ground. A further wearing rail 7 protects the lower edge of the feed plough 4.

The feed plough 4 consists of the actual ploughshare 8, which is reinforced on its rear side by ribs 9. In its upper portions, the ploughshare 8 is curved inwards slightly, as indicated by the radius R in FIG. 2. The ploughshare 8 has a window-like aperture 10, in which a belt conveyor element 11 is installed. This belt conveyor element 11 runs in the direction of the arrow F around return rollers with axes 12, 13 that are provided at opposing ends. The drive means is an hydraulic motor 14 located on the rear side of the feed plough 4, as shown clearly in FIG. 2. The conveyor belt of the belt conveyor element 11 has rib-shaped projections 15 extending transversely to the direction of transport. These projections, as illustrated in FIG. 1, may be narrow aluminium plates anchored in the conveyor belt. Alternatively, they may have the form illustrated in FIG. 3: here, the conveyor belt 16 has imbricate projections 17 which have steep sides 18 in the direction of transport in accordance with arrow F, and rear sides 19 that rise relatively gently in the counter-direction. This embodiment of the conveyor belt permits a low-friction transport of snow in the direction of transport F even when the belt conveyor element is stationery.

FIG. 2 shows the mounting of the belt conveyor element, the drive axle 13 of which is held at both ends in rotary bearings 20, 21 and is set in rotation by means of the hydraulic motor 14. The axle 13 forms an acute angle with the surface of the ground 22, this angle advantageously lying between 40° and 80°, and preferably being about 60°. In the region of the conveyor belt element 11, the ribs 9 provided on the rear side of the ploughshare 8 are provided with cutaway portions 23.

What is claimed is:

1. A rotary snow plow with at least one rotary element, a housing, a feed plough having a ploughshare attached to a side of the housing in order to increase the intake of snow with respect to a ground surface, the ploughshare of the feed plough including a belt conveyor element arranged laterally of the rotary plough, the plane of said belt conveyor element being parallel to the plane of the ploughshare and is set oblique to the ground surface so that the rear side of the ploughshare, in the direction of travel, forms an acute angle with the ground surface; and wherein the belt conveyor element is oriented with its conveying direction towards or above the rotational axis of the rotary element said ploughshare having an aperture said belt conveyor being installed in said aperture.

2. A rotary snow plough according to claim 1, in which the outermost return point of the belt conveyor element forms the outer edge of the ploughshare.

3. A rotary snow plough according to claim 1, in which the belt conveyor element is arranged to be driven independently of the rotary elements(s).

4. A rotary snow plough according to claim 1, in which the speed of rotation of the belt conveyor element is variable independently of the rotary element.

5. A rotary snow plough according to claim 1, in which the speed of rotation of the belt conveyor element is arranged to correspond at least to the clearing speed of the plough.

6. A rotary snow plough according to claim 1, in which the belt conveyor element comprises a conveyor belt having projections extending transversely to the direction of rotation of the belt conveyor element.

7. A rotary snow plough according to claim 1, in which the projection are of imbricate construction, and have a steeply rising cross sectional shape in the direction of transport.

* * * * *